US009542819B2

(12) United States Patent
Lee et al.

(10) Patent No.: US 9,542,819 B2
(45) Date of Patent: Jan. 10, 2017

(54) HOME APPLIANCE AND CONTROLLING METHOD THEREOF

(71) Applicant: SAMSUNG ELECTRONICS CO., LTD., Suwon-si, Gyeonggi-do (KR)

(72) Inventors: Jae Poong Lee, Suwon-si (KR); Chang Ho Ha, Hwasun-gun (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 16 days.

(21) Appl. No.: 14/479,780

(22) Filed: Sep. 8, 2014

(65) Prior Publication Data

US 2015/0179027 A1 Jun. 25, 2015

(30) Foreign Application Priority Data

Dec. 24, 2013 (KR) ..... 10-2013-0162087

(51) Int. Cl.
*G08B 21/00* (2006.01)
*G08B 6/00* (2006.01)
*G08B 3/10* (2006.01)

(52) U.S. Cl.
CPC .. *G08B 6/00* (2013.01); *G08B 3/10* (2013.01)

(58) Field of Classification Search
CPC ..... G08B 3/10; G08B 6/00; G01V 11/002; B60R 16/0315; G08C 2201/50; G07C 9/00896; G07C 5/008
USPC .... 340/3.1, 5.2, 5.1, 407.1, 407.2, 540, 635; 345/173
See application file for complete search history.

(56) References Cited

U.S. PATENT DOCUMENTS 6,157,313 A * 12/2000 Emmermann ..... G08B 5/223 340/12.54
2003/0024281 A1* 2/2003 Peterson ..... D06F 33/02 68/12.27
2004/0189462 A1* 9/2004 Eilers ..... D06F 33/02 340/531
2006/0017691 A1* 1/2006 Cruz-Hernandez ..... G06F 3/016 345/156
2008/0113321 A1* 5/2008 Kelley ..... G09B 5/062 434/169
2009/0044137 A1* 2/2009 Bartley ..... G06F 9/54 715/764
2009/0189747 A1* 7/2009 Baier ..... F24C 7/082 340/407.1
2009/0267892 A1 10/2009 Faubert
2010/0295678 A1* 11/2010 Suzuki ..... H04M 19/044 340/540
2011/0102145 A1* 5/2011 Park ..... G06F 3/016 340/6.1
2011/0148651 A1* 6/2011 Hendrickson ..... D06F 33/02 340/686.6
2011/0157052 A1* 6/2011 Lee ..... G06F 1/1626 345/173
2011/0267294 A1* 11/2011 Kildal ..... G06F 3/0414 345/173

(Continued)

*Primary Examiner* — Hoi Lau
(74) *Attorney, Agent, or Firm* — Staas & Halsey LLP

(57) ABSTRACT

A home appliance includes a tactile signal generator and a controller. The tactile signal generator has a first function which allows the home appliance to perform a predetermined function and a second function to generate a tactile signal. The controller determines whether an event is generated and controls the generation of the tactile signal generated by the tactile signal generator upon determination that the event is generated.

23 Claims, 13 Drawing Sheets

(56) References Cited

U.S. PATENT DOCUMENTS

| | | | | |
|---|---|---|---|---|
| 2011/0296879 | A1* | 12/2011 | Seo | D06F 25/00 68/23 R |
| 2012/0049999 | A1* | 3/2012 | Pelkey | G05B 23/0224 340/3.1 |
| 2012/0056825 | A1* | 3/2012 | Ramsay | G06F 3/016 345/173 |
| 2014/0115792 | A1* | 5/2014 | Lee | D06F 37/203 8/137 |
| 2014/0238089 | A1* | 8/2014 | Jeong | F04D 29/708 68/18 F |
| 2014/0253302 | A1* | 9/2014 | Levesque | G06F 3/016 340/407.1 |
| 2014/0285453 | A1* | 9/2014 | Park | G06F 3/016 345/173 |

* cited by examiner

HOME APPLIANCE AND CONTROLLING METHOD THEREOF

CROSS-REFERENCE TO RELATED APPLICATIONS

This application claims the benefit of Korean Patent Application No. 10-2013-0162087, filed on Dec. 24, 2013 in the Korean Intellectual Property Office, the disclosure of which is incorporated herein by reference.

BACKGROUND

1. Field

Embodiments of the present disclosure relate to home appliances to notify a user of generation of an event using a tactile signal.

2. Description of the Related Art

In general, home appliances send feedback regarding generation of an event to a user using audio signals, visual signals, and the like. In order to notify the user of the event, home appliances need to include an additional component.

For example, a washing machine that is a machine used to wash laundry using electric power includes a tub to contain wash water, a rotary tub rotatably installed in the tub, a drive device to rotate the rotary tub, a water supply device to supply water to the tub, and a drain pump to forcibly discharge the wash water from the tub.

A variety of events may be generated in a washing machine while washing laundry. In general, a user is notified of generation of an event via a speaker or a display mounted in the washing machine.

Meanwhile, a drain pump generally includes a pump case, which includes a wash water inlet chamber to contain wash water and a drain pump chamber, and a pumping motor installed at one side of the pump case. A pump filter to remove foreign matters contained in the wash water is installed in the pump case, and an impeller rotatably driven by the pumping motor is installed in the drain pump chamber. When the drain pump is driven, vibration generally occurs.

SUMMARY

It is an aspect of the present disclosure to provide a home appliance to determine generation of an event and generate a tactile signal corresponding to the generated event, and a method of controlling the home appliance.

Additional aspects of the disclosure will be set forth in part in the description which follows and, in part, will be obvious from the description, or may be learned by practice of the disclosure.

In accordance with an aspect of the present disclosure, a home appliance includes a tactile signal generator having a first function and a second function to generate a tactile signal, and a controller to determine whether an event is generated and control the generation of the tactile signal by the tactile signal generator upon determination that the event is generated.

The tactile signal may include vibration. The event may include at least one event selected from the group consisting of an input event generated by a setting input for the home appliance, a driving event generated during driving of the home appliance, and an inspection event generated related to an inspection of the home appliance.

The controller may determine whether the setting input the home appliance is a normal input, and determine that an input event is generated upon determination that the input is an abnormal input.

The home appliance may further include at least one sensor to detect a state of the home appliance, and the controller may determine whether the driving event is generated based on a driving state of the home appliance detected by the at least one sensor.

The home appliance may further include a storage unit to store history information related to driving of the home appliance, and the controller may determine whether the inspection event is generated based on the history information.

The controller may determine a pattern of the tactile signal in accordance with the event.

The home appliance may further include a sound generator to generate an audio signal when the event is generated. A pattern of the audio signal may be determined in accordance with a pattern of the tactile signal. The controller may control a tactile signal generator or a sound generator to generate at least one signal selected from the group consisting of the audio signal and the tactile signal.

The tactile signal generator may include a drain pump to discharge water from a washing tub.

The sensor may include at least one sensor selected from the group consisting of: a weight sensor to sense a weight of a tub containing water; and a door sensor to sense whether a door is opened or closed, and the controller may determine whether laundry is remained in the tub using the at least one sensor selected from the group consisting of the weight sensor and the door sensor, and determine that the driving event is generated upon determination that the laundry is remained in the tub.

The drain pump may further include a pump filter to remove foreign matters contained in wash water introduced from the tub, and the controller may determine whether replacement of the pump filter is required based on the history information, and determine that the inspection event is generated upon determining that replacement of the pump filter is required.

The home appliance may further include a washing tub rotatably installed in the tub and accommodating laundry, and the controller may determine whether cleaning of the washing tub is required based on the history information, and determine that the inspection event is generated upon determining that cleaning of the pump filter is required.

The home appliance may further include a water supply valve including a water supply filter to remove foreign matters contained in water supplied to the tub, and the controller may determine whether replacement of the water supply filter is required by comparing normal water supplying time with real water supplying time, and determine that the inspection event is generated upon determining that replacement of the water supply filter is required.

The tactile signal generator may include a fan motor of a vacuum cleaner to suck air.

In accordance with another aspect of the present disclosure, a method of controlling a home appliance including a tactile signal generator having a first function and a second function to generate a tactile signal includes determining whether an event is generated, and generating a tactile signal by driving the tactile signal generator according to the generated event.

The event may include at least one event selected from the group consisting of an input event generated by a user input, a driving event generated during driving of the home appliance, and an inspection event generated related to an inspection of the home appliance.

The determining of whether an event is generated may include determining that the input event is generated when the user input is generated.

The determining of whether an event is generated may include detecting a state of the home appliance, and determining whether the driving event is generated based on the detected state of the home appliance.

The determining of whether an event is generated may include determining whether the inspection event is generated based on history information related to driving of the home appliance.

The method may further include searching for a pattern of the tactile signal corresponding to the generated event, and the generating of the tactile signal may include generating the tactile signal in accordance with the searched pattern of the tactile signal.

The generating of the tactile signal may include generating an audio signal in accordance with the generated event.

A pattern of the audio signal may be determined in accordance with a pattern of the tactile signal.

In accordance with another aspect of the present disclosure, a home appliance is described. The home appliance includes a tactile signal generator configured to perform a first function comprising a predetermined operation of the home appliance that allows the home appliance to perform a predetermined function that is an operating function of the home appliance and to perform a second function to generate a tactile signal providing notice of an event and a controller to determine whether the event has been generated by the home appliance and to control the generation of the tactile signal generated by the tactile signal generator upon determination that the event has been generated.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
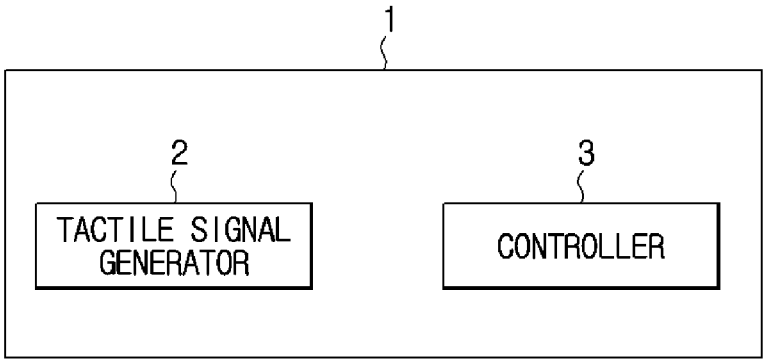
FIG. 1 is a control block diagram for describing a home appliance according to an embodiment of the present disclosure.

Reference will now be made in detail to the embodiments of the present disclosure, examples of which are illustrated in the accompanying drawings, wherein like reference numerals refer to like elements throughout. However, known functions associated with the present disclosure or detailed descriptions on the configuration and other matters unnecessarily obscure the gist of the present disclosure will be omitted.

Terms used herein are selected in consideration of functions in embodiments of the present disclosure and the meanings of the terms may vary depending on the intent of a user or an operator or customs. Accordingly, unless specified otherwise, the meanings of terms should be interpreted as those understood generally by those skilled in the art.

Although aspects and embodiments of the present disclosure are illustrated as a single integrated configuration in the drawings, the respective aspects and embodiments may be freely combined with each other as long as features thereof are not contradictory to each other.

FIG. 1 is a control block diagram for describing a home appliance 1 according to an embodiment of the present disclosure.

Referring to FIG. 1, the home appliance 1 includes a tactile signal generator 2 to generate a tactile signal according to operation thereof, and a controller 3 to control overall operation of the home appliance 1. In this regard, the tactile signal may include vibration, micro electrical stimulation, ultrasound, heat, an electromagnetic field, infrared light, and the like.

The tactile signal generator 2 may perform a predetermined operation in the home appliance 1 to allow the home appliance 1 to perform a predetermined function. In this case, as the tactile signal generator 2 performs an operation, a tactile signal is also generated. In addition, the tactile signal generator 2 may generate only a tactile signal in response to a control by the controller 3 and provide the user with tactile feedback. In other words, the tactile signal generator 2 may perform a first function to allow the home appliance 1 to perform a predetermined function and a second function to generate only a tactile signal and provide the tactile feedback to the user. In an embodiment, the tactile signal generated by the tactile signal generator 2 may be a predetermined tactile signal that corresponds to a predetermined event of a plurality of events performed by the appliance 1.

Thus, the tactile signal generator 2 may vary according to the home appliance 1. For example, if the home appliance 1 is a washing machine, the tactile signal generator 2 may be a drain pump mounted in the washing machine. If the home appliance 1 is a vacuum cleaner, the tactile signal generator 2 may be a fan motor mounted in the vacuum cleaner. If the home appliance 1 is an air cleaner, the tactile signal generator 2 may be a circulation unit used to discharge air. As described above, a tactile signal may be generated based on a conventional configuration to generate a tactile signal such as vibration of the home appliance 1, and thus the tactile signal may be provided to the user without using an additional device.

The controller 3 may control the tactile signal generator 2 to allow the home appliance 1 to operate. When an event is generated, the controller 3 may control the tactile signal generator 2 to generate a tactile signal in response to the event. Meanwhile, the event may be generated when various conditions are satisfied. Particularly, the event may include an input event generated by a user input, a driving event generated while the home appliance 1 is driven, an inspection event generated with regard to an inspection of the home appliance 1, and the like.

In addition, the controller 3 may generate different tactile signal patterns on the basis of events based on a pattern database that stores patterns of tactile signals to be generated with respect to each event. In addition, the controller 3 may control the tactile signal generator 2 such that the tactile signal generated by the tactile signal generator 2 has the same pattern as a conventional audio signal. Hereinafter, as examples of the home appliance 1 according to an embodiment of the present disclosure, a washing machine and a vacuum cleaner will be described in detail. However, embodiments of the present disclosure are not limited thereto, and any other home appliances including a component corresponding to the tactile signal generator 2 having the first and second functions may also be applied thereto.

Figure 2:
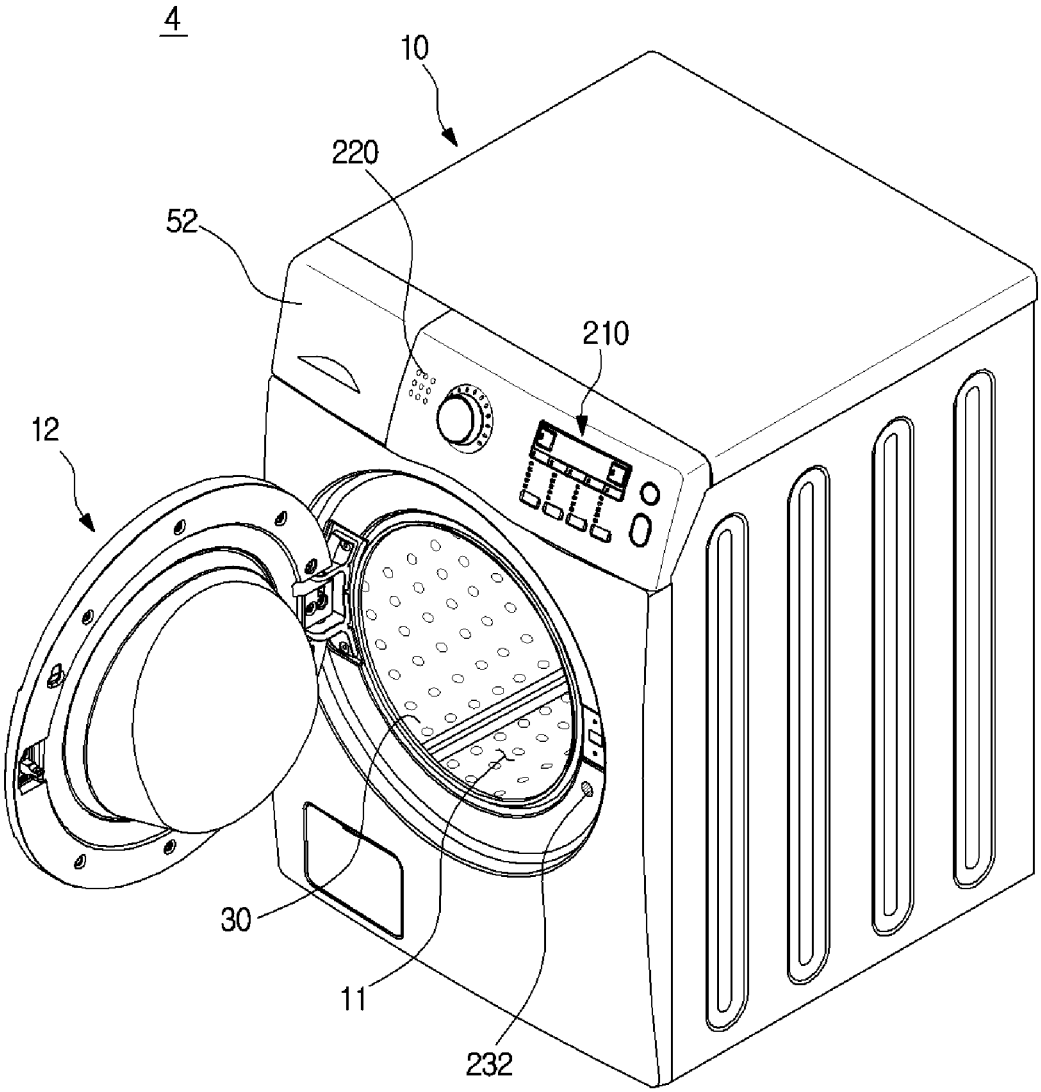
FIG. 2 is a perspective view for describing a washing machine according to an embodiment of the present disclosure.
Figure 3:
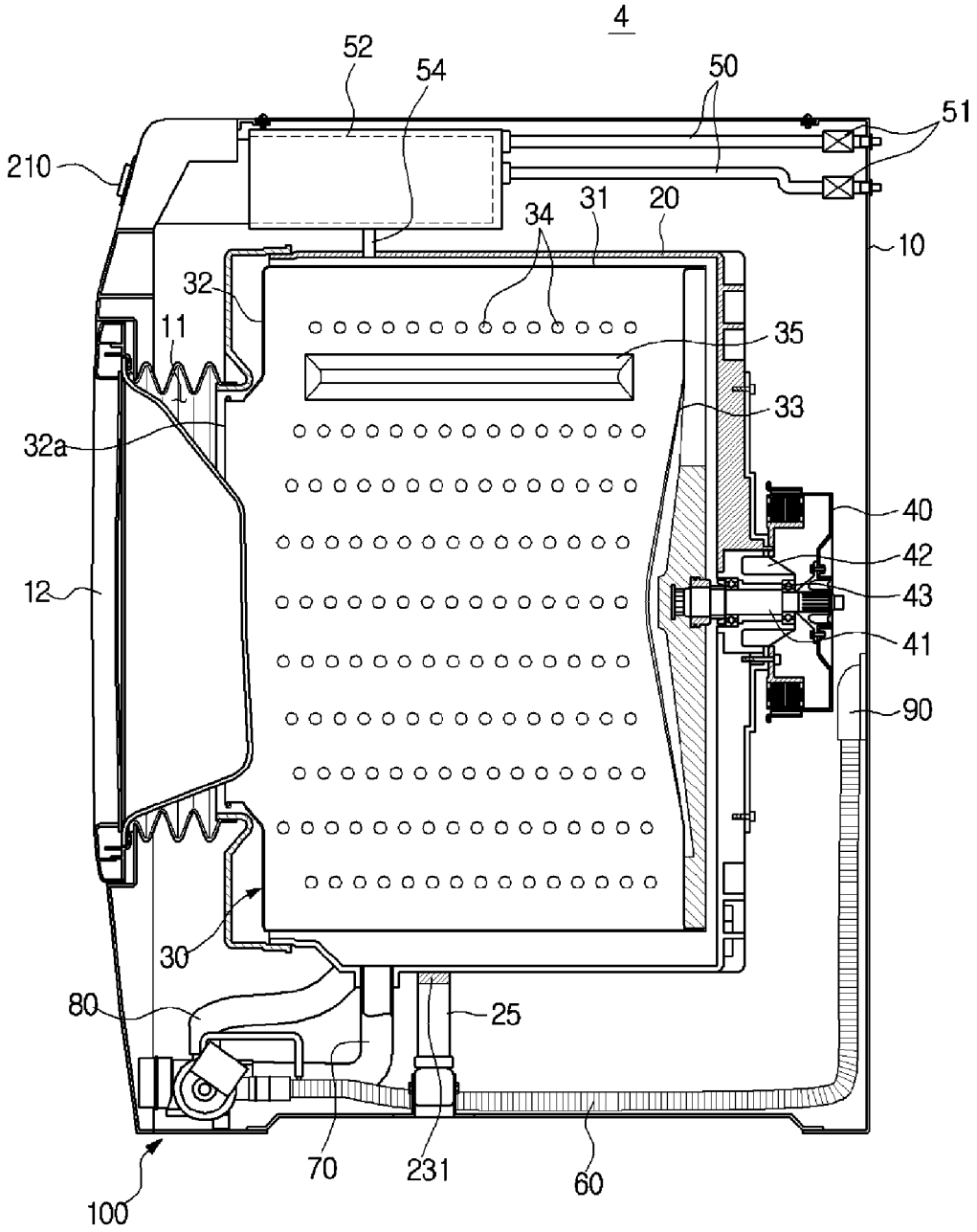
FIG. 3 is a cross-sectional view for describing a washing machine according to an embodiment of the present disclosure.
Figure 4:
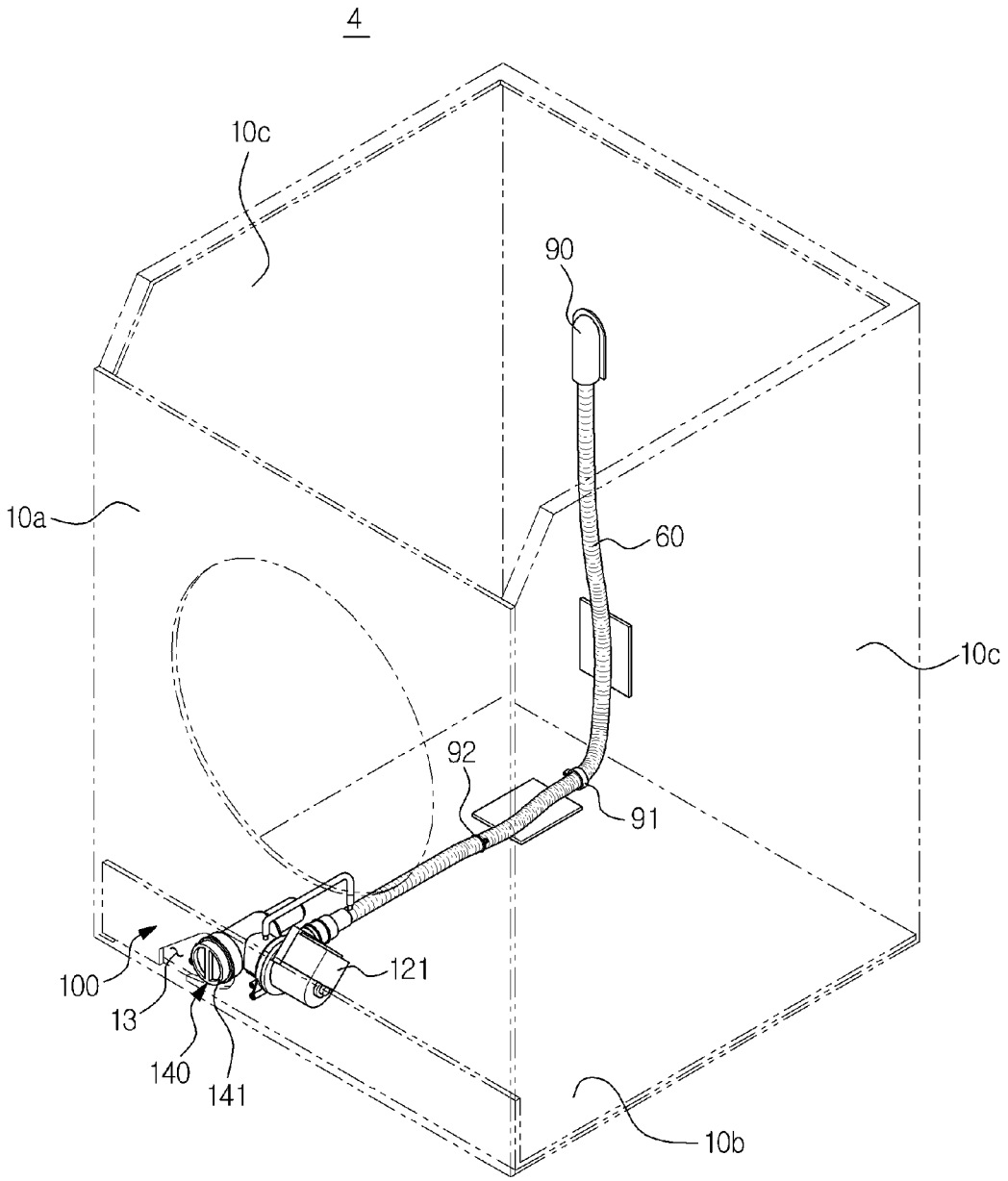
FIG. 4 is a perspective view illustrating a drain pump and a drain hose of the washing machine of FIG. 3.

FIG. 2 is a perspective view for describing a washing machine according to an embodiment of the present disclosure. FIG. 3 is a cross-sectional view for describing a washing machine according to an embodiment of the present disclosure. FIG. 4 is a perspective view illustrating a drain pump and a drain hose of the washing machine of FIG. 3.

As illustrated in FIGS. 2 to 4, a washing machine 4 includes a cabinet 10 defining an external appearance, a tub 20 mounted in the cabinet 10, a washing tub 30 rotatably mounted in the tub 20, and a driving motor 40 to drive the washing tub 30.

The cabinet 10 includes a plurality of frames 10*a*, 10*b*, and 10*c*, and the frames 10*a*, 10*b*, and 10*c* include a front frame 10*a* constituting the front surface of the cabinet 10, a side frame 10*c* constituting side surfaces and the back surface, and a lower frame 10*b* constituting the bottom surface.

A control panel 210 is mounted at an upper portion of the front frame 10*a* to receive a manipulation instruction regarding the washing machine 4 from a user and to display operation information of the washing machine 4. The control panel 210 will be described later in more detail.

In addition, a sound generator 220 such as a speaker may be mounted at another upper portion of the front frame 10*a*.

The lower frame 10*b* has a portion bent upward and coupled to the front frame 10*a* at the front side.

A laundry inlet 11 is formed on the front surface of the cabinet 10 such that laundry is put into the washing tub 30. The laundry inlet is opened and closed by a door 12 installed at a front portion of the cabinet 10.

Meanwhile, a door sensor 220 may be installed at the front surface of the laundry inlet 11. In this case, the door sensor 220 is located between the laundry inlet 11 and the door 12 to sense opening and closing of the door 12.

The tub 20 is supported by a damper 25. The damper 25 connects the inner bottom surface of the cabinet 10 and the external surface of the tub 20. In this case, a weight sensor 231 may be installed between the tub 20 and the damper 25. The weight sensor 231 may measure a weight of the tub 20. The washing machine 4 determines whether laundry remains in the washing tub 30 based on the weight measured by the weight sensor 231.

A water supply pipe 50 to supply wash water into the tub 20 is installed at an upper portion of the tub 20. A water supply valve 51 is installed at one end of the water supply pipe 50. The water supply valve 51 is connected to an external water supply source (not shown) and controls water supply to the washing machine 4.

In addition, the water supply valve 51 may include a water supply filter (not shown), which removes foreign matters contained in water supplied into the tub 20. Meanwhile, the other end of the water supply pipe 50 is connected to a detergent supply device 52.

The detergent supply device 52 is connected to the tub 20 via a connection pipe 54. Water supplied through the water supply pipe 50 is supplied into the tub 20 together with a detergent via the detergent supply device 52.

The washing tub 30 includes a cylindrical body 31, a front plate 32 disposed at the front end of the cylindrical body 31, and a read plate 33 disposed at the rear end of the cylindrical body 31. The front plate 32 is provided with an opening 32*a* for entrance and exit of laundry, and the rear plate 33 is connected to a drive shaft 41 to transfer driving force of the driving motor 40.

A plurality of through-holes 34 for passage of wash water is formed in the periphery of the washing tub 30 such that the inner space of the washing tub 30 communicates with the inner space of the tub 20.

A plurality of lifters 35 is provided at an inner peripheral surface of the washing tub 30 such that laundry is raised and dropped during rotation of the washing tub 30.

The drive shaft 41 is placed between the washing tub 30 and the driving motor 40. One end of the drive shaft 41 is connected to the rear plate 33 of the washing tub 30, and the other end of the drive shaft 41 extends outward from a rear wall of the tub 20. When the driving motor 40 drives the drive shaft 41, the washing tub 30 connected to the drive shaft 41 rotates about the drive shaft 41.

A bearing housing 42 is installed at the rear wall of the tub 20 to rotatably support the drive shaft 41. The bearing housing 42 may be formed of an aluminum alloy and may be inserted into the rear wall of the tub 20 when the tub 20 is manufactured through injection molding. A plurality of bearings 43 are installed between the bearing housing 42 and the drive shaft 41 to ensure smooth rotation of the drive shaft 41.

During a washing cycle, the driving motor 40 rotates the washing tub 30 at a low velocity in a regular direction and in the reverse direction, and accordingly tumbling of the laundry within the washing tub 30 is repeated, thereby removing contamination from the laundry. The driving motor 40 may be a brushless direct current (BLDC) motor or a synchronous alternating current (AC) motor, rotating velocity of which is easily controlled.

During a spin-drying cycle, when the driving motor 40 rotates the washing tub 30 at a high velocity in one direction, water is separated from the laundry by centrifugal force applied to the laundry.

A drain pump 100, which pumps the wash water contained in the tub 20, is installed at an inner lower portion of the cabinet 10. The drain pump 100 discharges the wash water out of the washing machine through a drain hose 60.

The drain pump 100 is exposed to the front surface of the cabinet 10 via a through-hole 13 formed at a portion in which a protrusion of the lower frame 10*b* and a lower portion of the front frame 10*a* overlap each other.

The drain hose 60 is installed in the cabinet 10 by using a hose wire 92 and a hose holder 91 so as not to interfere with other parts mounted in the cabinet 10 and is guided out of the cabinet 10 by a hose guide 90.

Figure 5:
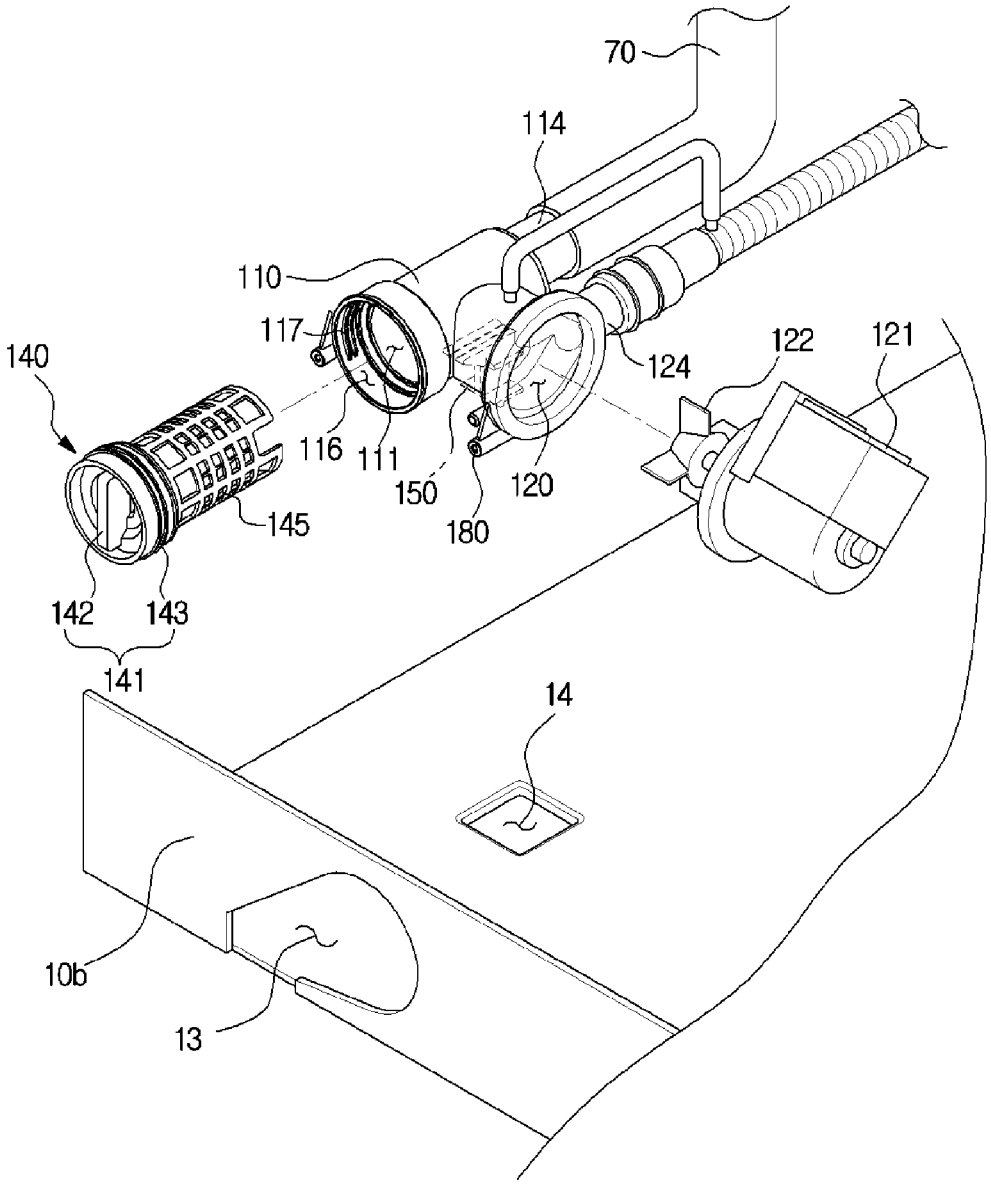
FIG. 5 is an exploded perspective view illustrating a drain pump installed in a washing machine according to an embodiment of the present disclosure.

FIG. 5 is an exploded perspective view illustrating a drain pump 100 in detail according to an embodiment of the present disclosure.

As illustrated in FIGS. 4 and 5, the drain pump 100 includes a wash water inlet chamber 111, a pump case 110 including a drain pump chamber 120, and a pump filter 140 inserted into the wash water inlet chamber 111.

An impeller 122 is mounted in the drain pump chamber 120 of the pump case 110 to forcibly suction the wash water from the wash water inlet chamber 120 and discharge the wash water, and a pumping motor 121 is connected to the impeller 122. The impeller 122 suctions the wash water contained in the wash water inlet chamber 111 in a lateral direction and discharges the wash water in a radial direction while being rotated by the pumping motor 121.

The pump filter 140 is mounted on the front surface of the wash water inlet chamber 111 and removes foreign matters contained in the wash water introduced from the tub 20.

The pump filter 140 has a hollow cylindrical shape and includes a head 141 and a body 145. When the pump filter 140 is mounted in the pump case 110, the body 145 of the pump filter 140 is accommodated in the wash water inlet chamber 111 of the pump case 110.

A second thread 143 is formed at a side surface of the head 141 such that the pump filter 140 is screw engaged with the pump case 110. A knob 142 is mounted at the front surface of the head 141 such that a user may grab the knob 142 to rotate the head 141.

The wash water inlet chamber 111 has an entrance 116 at a front side thereof such that the pump filter 140 is inserted through the entrance 116, and a first thread 117 is formed to correspond to the second thread 143 of the pump filter 140 at an edge of the entrance 116.

The head 141 of the pump filter 140 is exposed to the front surface of the cabinet 10 via a through-hole 13 that penetrates the lower frame 10*b* and the front frame 10*a*. A cover (not shown) to cover the through-hole 13 is coupled to the front frame 10*a*.

The user may replace or clean the pump filter 140 by separating the pump filter 140 from the drain pump 100 by opening the cover (not shown) and grabbing and rotating the exposed knob 142 of the head 141 of the pump filter 140.

The pump case 110 is coupled to the lower frame 10*b* via a mount unit 150 mounted at a lower portion of the pump case 110. When the mount unit 150 is inserted into and coupled to a coupling groove 14 formed at the lower frame 10*b* to correspond to the mount unit 150, the pump case 110 and the lower frame 10*b* are coupled to each other.

Residual water contained in the pump case 110 may be discharged through a residual water outlet 180 mounted at a lower end of the pump case 110. A residual water hose (not shown) has one end connected to the residual water outlet 180 and the other end exposed to the front surface of the cabinet 10 via the through-hole 13. Thus, the user may remove the residual water contained in the pump case 110 using the residual water hose (not shown) exposed to the front surface of the cabinet 10.

An inlet 114 is formed to protrude backward from the wash water inlet chamber 111. The wash water inlet chamber 111 communicates with the inlet 114, and an inlet hole (not shown) is formed at a connection portion between the wash water inlet chamber 111 and the inlet 114 to connect the wash water inlet chamber 111 and the inlet 114.

The inlet 114 is connected to an inlet hose 70, and the wash water contained in the tub 20 is introduced via the inlet hole into the wash water inlet chamber 111 through the inlet hose 70 and the inlet 114.

Since the wash water inlet chamber 111 is connected to the drain pump chamber 120, the wash water introduced into the wash water inlet chamber 111 is introduced into the drain pump chamber 120.

In addition, the drain hose 60 is connected to the drain pump chamber 120, and the drain hose 60 guides the wash water pumped by the impeller 122 out of the cabinet 10 to discharge the wash water.

An outlet 124 to discharge the wash water pumped by the impeller 122 to the outside extends backward from the drain pump chamber 120, and the drain pump chamber 120 communicates with the outlet 124. An outlet hole (not shown) is formed between the outlet 124 and the drain pump chamber 120.

The drain hose 60 is connected to the outlet 124. The outlet 124 and the drain hose 60 constitute a drain line that guides the wash water from the drain pump chamber 120 to the outside of the washing machine 4.

The drain pump 100 as described above may be a tactile signal generator 2. In more detail, the drain pump 100 may perform a first function to discharge the wash water to the outside. The drain pump 100 may also perform a second function to generate a tactile signal according to an event based on micro vibration generated during the operation thereof.

Figure 6:
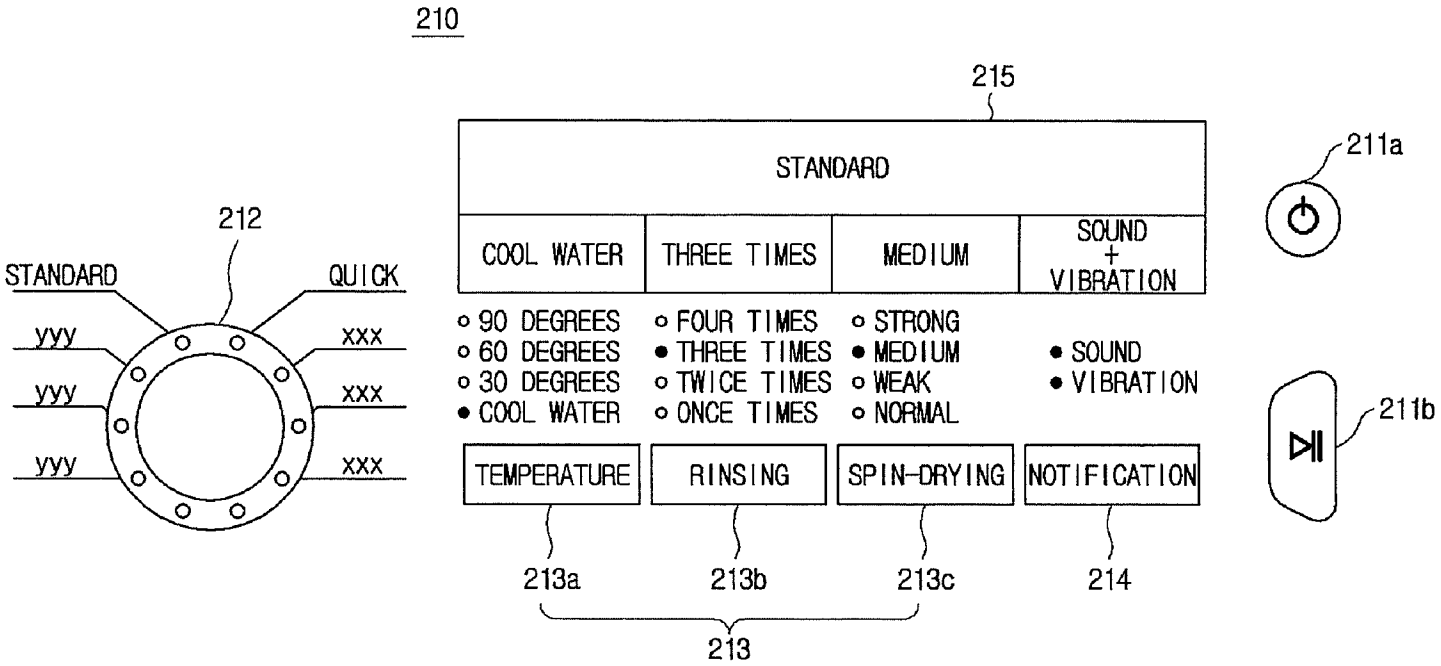
FIG. 6 is a diagram illustrating a control panel mounted at a washing machine according to an embodiment of the present disclosure.

FIG. 6 is a diagram illustrating a control panel 210 mounted at a washing machine 4 according to an embodiment of the present disclosure. The control panel 210 receives at least one setting instruction from a user.

As illustrated in FIG. 6, the control panel 210 includes a power button 211*a* to turn on and off the washing machine 4, a start/pause button 211*b* to start or pause operation of the washing machine 4, a dial 212 to select a washing course in which a washing cycle, a rinsing cycle, and a spin-drying cycle are pre-stored according to the type of laundry, an option button 213 to select additional functions of the washing course selected using the dial 212, a notification method selection button 214 to select a method of notifying an event generated in the washing machine 4, and a display panel 215 to display information regarding operation of the washing machine 4.

The option button 213 includes a water temperature setting button 213*a* for setting temperature of water used during the washing cycle, a rinsing setting button 213*b* for setting the number of rinsing cycles, and a spin-drying setting button 213*c* for setting spin speed of the spin-drying cycle.

The notification method selection button 214 selects a method of notifying the user of an event generated in the washing machine 4. In this regard, the event will be described later in more detail.

More particularly, the washing machine 4 may notify the user of generation of an event. In general, the washing machine 4 may notify the user of various events generated in the washing machine 4 by generating a tactile signal or a visual signal.

For example, the washing machine 4 may generate a visual signal and display the visual signal on the display panel 215 to notify the user of generation of the event.

Alternatively, the washing machine 4 may generate an audio signal by using a sound generator 220 to notify the user of generation of the event.

In addition, according to an embodiment, the washing machine 4 may drive the drain pump 100 mounted in the washing machine 4 to generate a tactile signal and notify the user of generation of the event by using the tactile signal.

In other words, the user may select a notification method of the event by using the notification method selection button 214. The washing machine 4 notifies the user of the generation of the event by using only a method selected by the user between an audio signal (sound) or a tactile signal such as a vibration. Accordingly, the washing machine 4 may have high emotional quality as the generation of the event is notified by using only the method selected by the user.

The power button 211*a*, the start/pause button 211*b*, the option button 213, and the notification method selection button 214 may be implemented using a micro switch to detect pressure applied by the user, a membrane switch, a touch pad to detect a touch by the user, or the like.

The display panel 215 displays information regarding operation of the washing machine 4 such as the washing course selected by using the dial 212, settings of additional functions selected by the option button 213, information regarding the cycle performed by the washing machine 4, and the remaining time until the washing course is terminated. The display panel 215 may include a liquid crystal display (LCD) panel or a light emitting diode (LED) panel.

Besides, the control panel 110 may also include a touch screen panel (TSP) in which a touch pad, which receives a manipulation instruction from the user, and a display panel, which displays operation information of the washing machine 4, are integrated.

Figure 7:
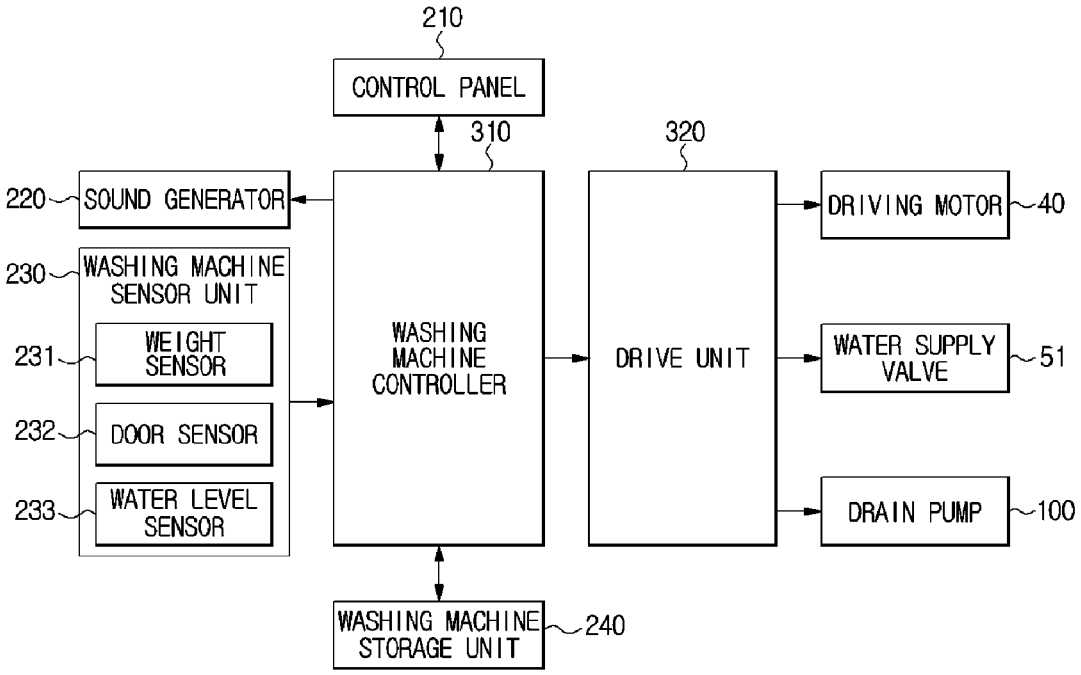
FIG. 7 is a control block diagram for describing a washing machine according to an embodiment of the present disclosure.

FIG. 7 is a control block diagram for describing a washing machine 4 according to an embodiment of the present disclosure.

Referring to FIG. 7, the washing machine 4 includes a drive unit 320, which drives the driving motor 40, the water supply valve 51, the drain pump 100, and the like, a washing machine storage unit 240 to store programs and data related to operation of the washing machine 4, and a washing machine controller 310 to control overall operation of the washing machine 4.

The control panel 210 may receive an input regarding settings of the washing course from the user as described above and may notify the user of a state of the washing machine 4, a proceeding state of the washing course, and generation of various events through the display panel 215.

The sound generator 220 generates an audio signal according to a control by the washing machine controller 310. More particularly, the sound generator 220 may generate an audio signal regarding various events generated in the washing machine 4 and notify the user of the event generated in the washing machine 4. In this regard, the sound generator 220 may be a speaker.

A washing machine sensor unit 230 detects the state of the washing machine 4 or senses change of the state of the washing machine 4 and transmits the detected result to the washing machine controller 310. More particularly, the washing machine sensor unit 230 may include a weight sensor 231, a door sensor 232, and a water level sensor 233.

The weight sensor 231 is disposed between the tub 20 and the damper 25 to measure the weight of the tub 20. The weight of the tub 20 measured using the weight sensor 231 may be used to determine whether laundry is remained in the washing tub 30.

The door sensor 232 is provided at the front surface of the laundry inlet 11 to sense opening and closing of the door 12. Information regarding the opening and closing of the door 12 sensed by the door sensor 232 may be used to determine whether the user takes the laundry out of the washing machine 4. The door sensor 232 may be implemented using an infrared light sensor.

The water level sensor 233 may measure the level of water contained in the tub 20.

The washing machine storage unit 240 may store programs and data to control operation of the washing machine 4. In addition, the washing machine storage unit 240 may store washing information of the washing machine 4. In this regard, the washing information is information regarding use of the washing machine 4, such as a total number of washing performed by the washing machine 4, a total amount of washed laundry, and a frequency of washing. The washing information may be stored in the washing machine storage unit 240 whenever the washing is terminated or started.

Meanwhile, the washing machine storage unit 240 may include non-volatile memories (not shown) such as magnetic discs and solid state discs and volatile memories (not shown), which temporarily store data generated during a controlling process of the washing machine 4, such as D-RAM and S-RAM.

A drive unit 320 drives a driving motor 40, a water supply valve 51, and a drain pump 100 according to a control signal of the washing machine controller 310. Particularly, the drive unit 320 may include an inverter to control rotation velocity and rotation direction of the driving motor 40.

In addition, the drive unit 320 may drive the drain pump 100 according to the control signal of the washing machine controller 310. That is, the drive unit 320 may drive the drain pump 100 according to the control signal of the washing machine controller 310 to allow the drain pump 100 to generate a tactile signal.

As described above, the user may efficiently be notified of generation of the event by generating a tactile signal by using the drain pump 100 and notifying generation of the event based on the generated tactile signal. In addition, since the tactile signal is generated without using an additional device to generate the tactile signal, the manufacturing costs of the washing machine 4 may be reduced, and the manufacturing process thereof may be simplified.

The washing machine controller 310 creates a control signal to control the driving motor 40, the water supply valve 51, and the drain pump 100 based on the setting instruction for washing input by the user via the control panel 210 and a detection result of the water level sensor 233 and transmits the created control signal to the drive unit 320.

In addition, when an event is generated, the washing machine controller 310 may generate a tactile signal and provide a feedback to the user. More particularly, the washing machine controller 310 may control the drive unit 320 to drive the drain pump 100, thereby generating a tactile signal. That is, when current is supplied to the pumping motor 121 according to controlling by the washing machine controller 310, the pumping motor 121 is rotated and the user may be notified of an event via vibration generated as the pumping motor 121 is rotated.

Hereinafter, the event generated in the washing machine 4 will be described in more detail. As described above, the event may include an input event generated by a user input, a driving event generated during a washing operation of the washing machine 4, an inspection event generated with regard to an inspection of the washing machine 4, and the like.

The input event may be generated by a user input. When the user inputs a setting instruction for washing via the control panel 210, the washing machine controller 310 may determine that an input event is generated. For example, when a setting instruction to select a washing course and options of the selected washing course is input via the dial 22, an input event may be generated. The input event may also be generated by an abnormal input by the user.

The driving event may be generated during a washing operation of the washing machine 4. More particularly, it may be determined whether the driving event is generated based on a state of the washing machine 4 after detecting the state of the washing machine 4. For example, the driving event may be generated when laundry is remained in the washing tub 30 after the washing course is terminated.

Figure 8:
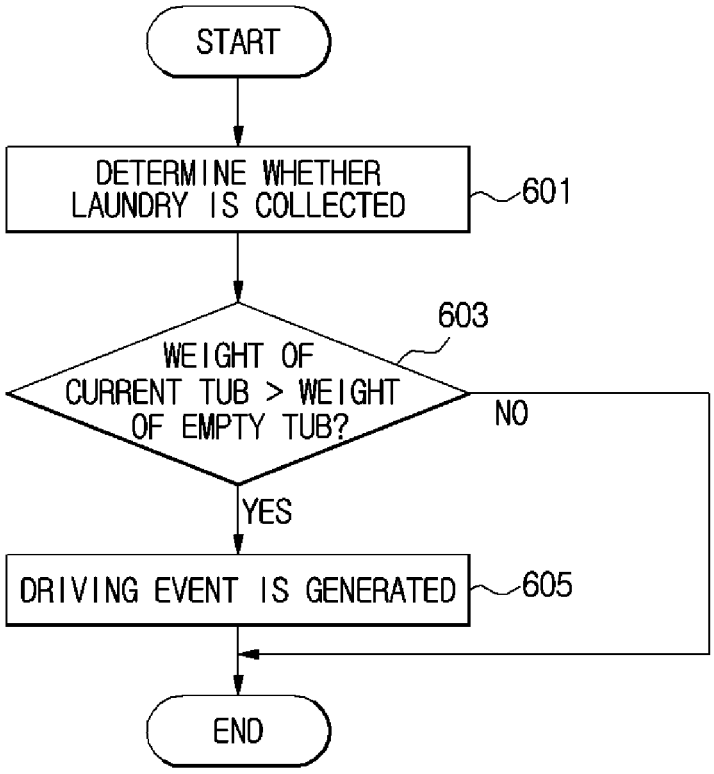
FIG. 8 is a flowchart for describing a driving event generated when laundry is remained in a washing tub.

FIG. 8 is a flowchart for describing a driving event generated when laundry is remained in a washing tub 30.

As illustrated in FIG. 8, the washing machine controller 310 determines whether the user collected the laundry (601). More particularly, when the door sensor 233 senses that the door 12 is opened and then closed after the washing course is terminated, the washing machine controller 310 may determines that the user collected the laundry.

Upon determination that the laundry was collected, the washing machine controller 310 compares a weight of the tub 20 in an empty state with a current weight of the tub 20 (603). In this case, the weight of the empty tub 20 may be pre-set, and the current weight of the tub 20 may be measured by the weight sensor 231. As such, it may be determined whether any laundry remains in the tub 20 by comparing the weight of the empty tub 20 with the current weight of the tub 20.

The washing machine controller 310 may determine that a driving event is generated when the current weight of the tub 20 is greater than the weight of the empty tub 20 (605). In this case, the washing machine controller 310 may control the drain pump 100 to generate a tactile signal corresponding to the driving event.

The inspection event may be generated with regard to an inspection of the washing machine 4. For example, the inspection event may be generated when cleaning of the washing tub 30 is required, replacement of the pump filter 140 provided in the drain pump 100 is required, or replacement of the water supply filter 52 provided in the water supply valve 51 is required.

Meanwhile, the washing machine controller 310 may manage washing history information in order to detect generation of the inspection event. In this regard, the washing history information refers to information regarding washing performed by the washing machine 4 such as a total number of washing performed by the washing machine 4, a total amount of laundry washed by the washing machine 4, period of use, and normal water supplying time.

Figure 9:
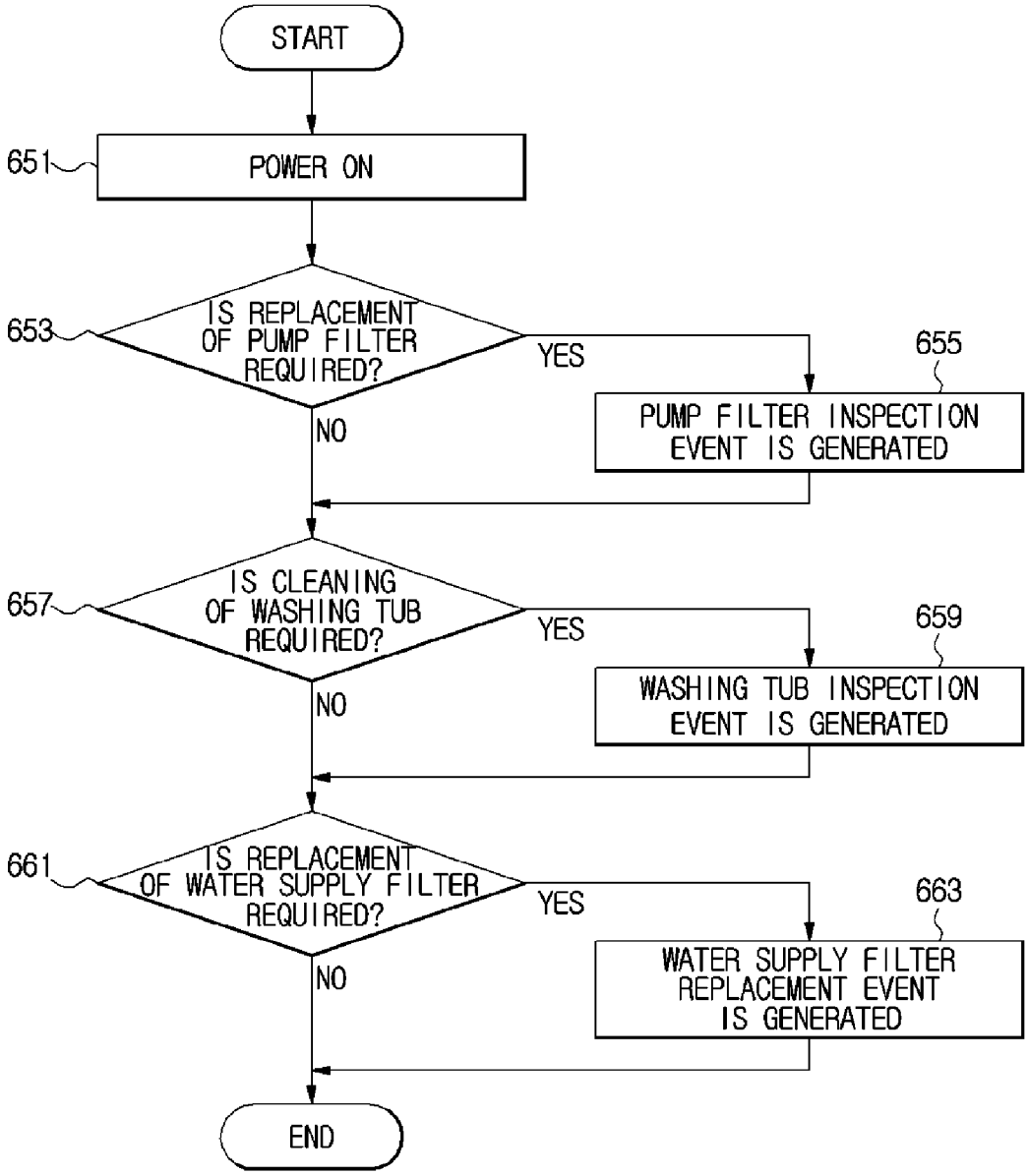
FIG. 9 is a flowchart for describing an inspection event in detail.

FIG. 9 is a flowchart for describing an inspection event in detail.

As illustrated in FIG. 9, when the power is turned on (651), the washing machine controller 310 may determine whether replacement of the pump filter 140 is required (653). In this case, the washing machine controller 310 may determine whether replacement of the pump filter 140 is required based on the pre-stored history information. For example, the washing machine controller 310 may determine that replacement of the pump filter 140 is required when the total amount of laundry washed by the washing machine 4 is greater than a critical point.

Then, upon determination that replacement of the pump filter 140 is required, the washing machine controller 310 may determine that an inspection event of the pump filter 140 is generated (655). In this case, the washing machine controller 310 may control the drain pump 100 to generate a tactile signal corresponding to the inspection event of the pump filter 140.

The washing machine controller 310 may determine whether cleaning of the washing tub 30 is required (657). In this case, the washing machine controller 310 may determine whether cleaning of the washing tub 30 is required based on the pre-stored history information. For example, the washing machine controller 310 may determine that cleaning of the washing tub 30 is required when the washing tub 30 has been used for more than a critical time period without being cleaned.

Upon determination that cleaning of the washing tub 30 is required, the washing machine controller 310 may determine that an inspection event of the washing tub 30 is generated (659). In this case, the washing machine controller 310 may control the drain pump 100 to generate a tactile signal corresponding to the inspection event of the washing tub 30.

Meanwhile, the washing machine controller 310 may determine whether replacement of the water supply filter 52 is required (661). In this case, the washing machine controller 310 may determine whether replacement of the water supply filter 52 is required based on the pre-stored history information. For example, the washing machine controller 310 may determine that replacement of the water supply filter 52 is required when the total number of washing performed by the washing machine 4 is greater than a critical number.

Upon determination that replacement of the water supply filter 52 is required, the washing machine controller 310 may determine that an inspection event of the water supply filter 52 is generated (663). In this case, the washing machine controller 310 may control the drain pump 100 to generate a tactile signal corresponding to the inspection event of the water supply filter 52.

Meanwhile, FIG. 9 exemplarily illustrates an inspection event and the order of determining generation of inspection events may vary, and determination of generation of the inspection event may be performed at different stages. For example, the washing machine controller 310 may determine the generation of the inspection event after the washing course is terminated.

In addition, the generation of the inspection events may be determined using various methods. For example, the washing machine controller 310 compares a normal water supplying time to the washing tub 30 with a real water supplying time thereto. When the real water supplying time is greater than the normal water supplying time by a critical time, it may be determined that an inspection event of the water supply filter 52 is generated.

Figure 10:
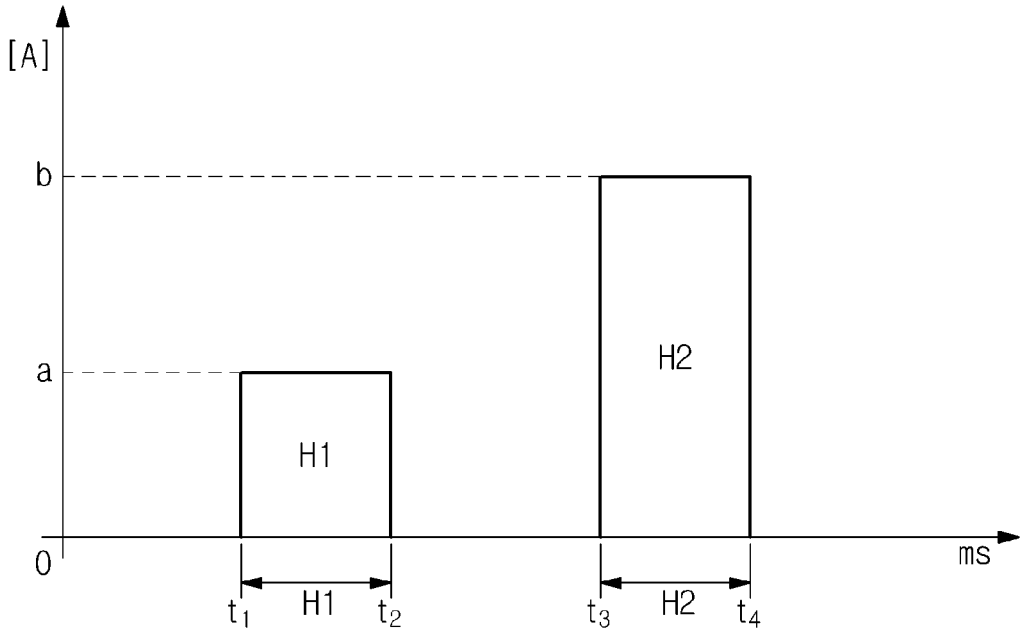
FIG. 10 is a graph illustrating a pattern of a tactile signal generated by a drain pump.

FIG. 10 is a graph illustrating a pattern of a tactile signal generated by a drain pump 100. In FIG. 10, the horizontal axis indicates time, and the vertical axis indicates current applied to the drain pump.

The washing machine controller 310 may control a pattern of the tactile signal generated by the drain pump 100. That is, the pattern of the tactile signal generated by the drain pump 100 may be controlled by adjusting current supplied to the drain pump 100.

More particularly, when high current is supplied to the pumping motor 120, the pumping motor 120 rotates at high speed, thereby generating relatively strong vibration. When low current is supplied to the pumping motor 120, the pumping motor 120 rotates at low speed, thereby generating relatively weak vibration.

For example, upon determination that an event is generated, the washing machine controller 310 may supply current to the pumping motor 120 as illustrated in FIG. 10. Accordingly, the pumping motor 120 is driven in section H1 between t1 and t2 and in section H2 between t3 and t4 to generate a tactile signal. In this case, relatively high current is supplied to the pumping motor 120 in section H2 compared to section H1, and accordingly, stronger vibration is generated in section H2 to which higher current is supplied compared to section H1.

Meanwhile, the drain pump 100 may generate different patterns of the tactile signals according to the event. To this end, the washing machine storage unit 240 may have a pattern database that stores patterns of tactile signals to be generated with respect to each event.

Thus, upon generation of an event, the washing machine controller 310 may search for a pattern of a tactile signal corresponding to the event and may control the drain pump 100 to generate the tactile signal in accordance with the searched pattern of the tactile signal.

As described above, since different tactile signals are generated on an event basis and provided to the user, the user may efficiently be notified of generation of the event.

In addition, upon determination that an event is generated, the washing machine controller 310 may control the sound generator 220 to generate an audio signal and may control the display panel 215 mounted on the control panel 310 to generate a visual signal.

More particularly, the washing machine controller 310 may control the sound generator to generate an audio signal corresponding to the generated event. In this case, the audio signal may be a digital music, a voice guide, and the like.

In addition, a pattern of the audio signal generated by the sound generator 220 may correspond to a pattern of the tactile signal generated by the drain pump 100. For example, when the drain pump 100 generates a stronger vibration, the sound generator 220 may output a higher sound. On the other hand when the drain pump 100 generates a weaker vibration, the sound generator 220 may output a lower sound.

As described above, the user may efficiently be notified of generation of the event by matching the pattern of the audio signal generated by the sound generator 220 to the pattern of the tactile signal generated by the drain pump 100.

Figure 11:
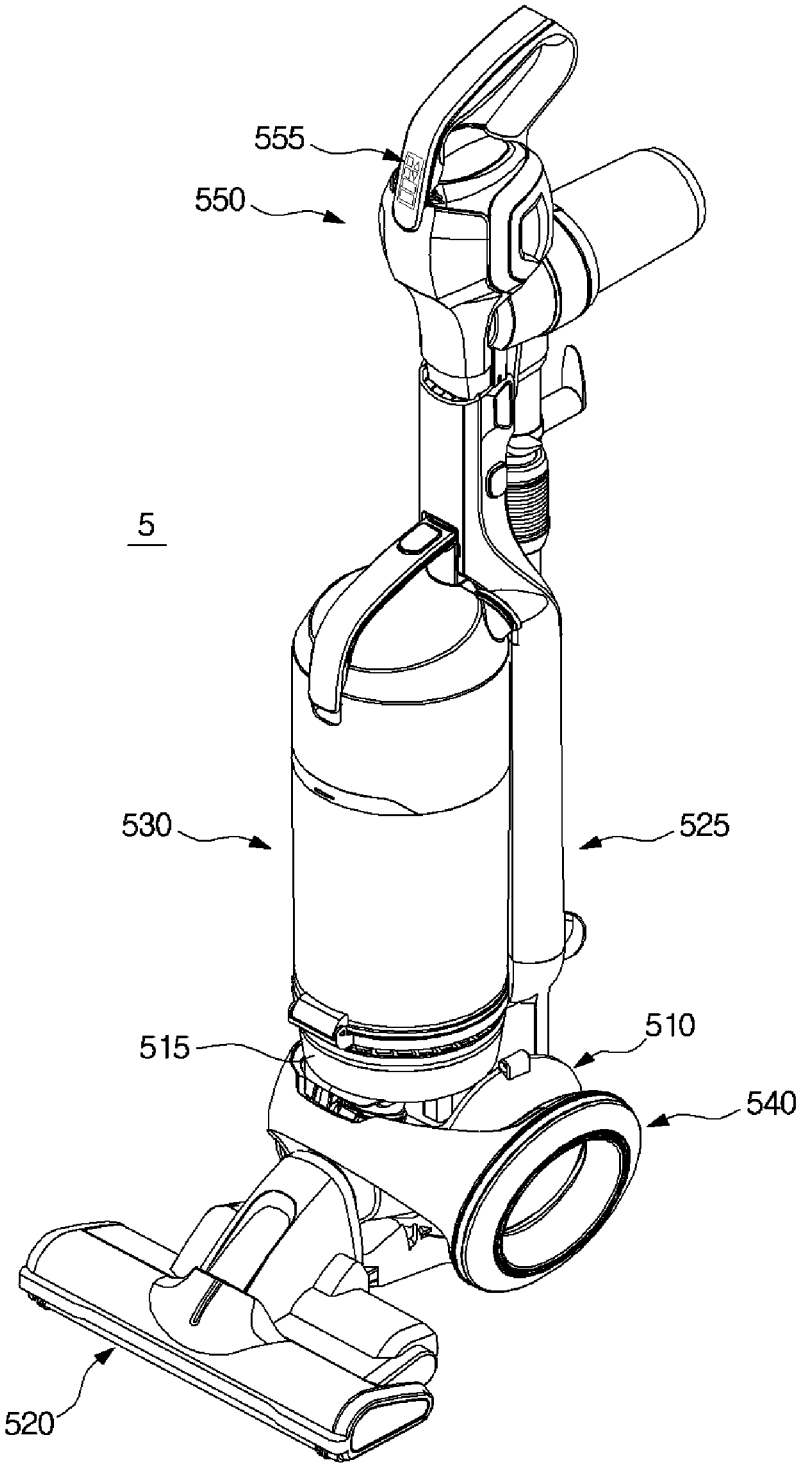
FIG. 11 is a perspective view for describing a vacuum cleaner according to an embodiment of the present disclosure.
Figure 12:
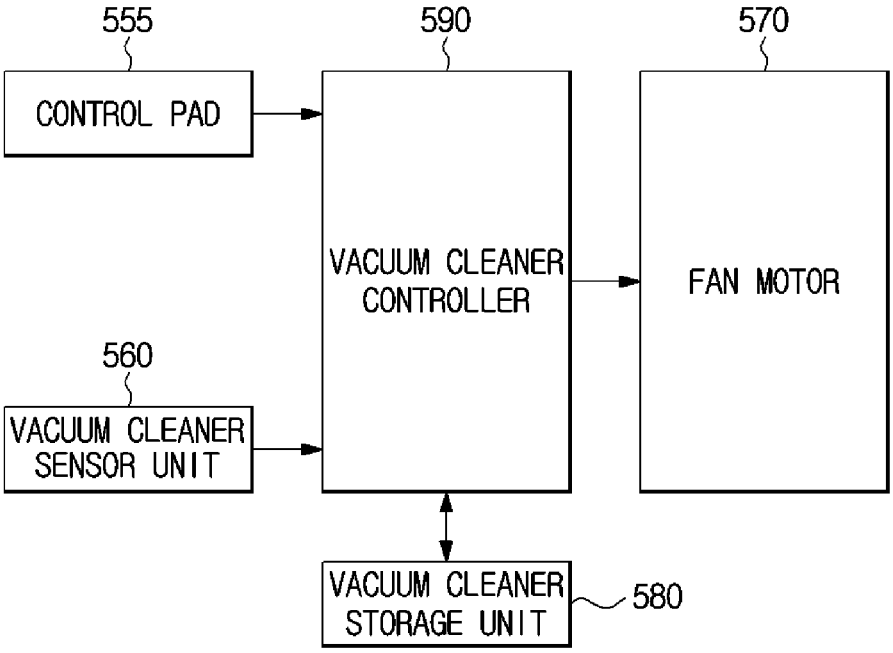
FIG. 12 is a control block diagram for describing a vacuum cleaner according to an embodiment of the present disclosure.

FIG. 11 is a perspective view for describing a vacuum cleaner 5 according to an embodiment of the present disclosure. FIG. 12 is a control block diagram for describing the vacuum cleaner 5 according to an embodiment of the present disclosure.

Referring to FIGS. 11 and 12, the vacuum cleaner 5 includes a main body 510, a suction unit 520 connected to the front side of the main body 510 for sucking air and dust from a floor surface to be cleaned in a state of being in contact with the floor surface, a cyclone dust collector 530 mounted at an upper portion of the main body 510 and separating dust from air sucked by the suction unit 520, a wheel assembly 540 mounted at the main body 510 to allow the main body 510 to move along the floor to be cleaned, a handle 550 grabbed by a user to move the vacuum cleaner 5, a vacuum cleaner sensor unit 560 to detect information related to a state of the vacuum cleaner 5, and a vacuum cleaner controller 590 to control overall operation of the vacuum cleaner 5 as illustrated in FIG. 11.

The main body 510 may include a motor housing 515 to accommodate a fan motor 570 that generates suction force as illustrated in FIG. 12. In addition, the cyclone dust collector 530 may be coupled to an upper portion of the motor housing 515. The wheel assembly 540 may be rotated based on the direction of the main body 510.

The suction unit 520 has a suction hole (not shown) at the bottom surface thereof and sucks air and dust from the floor surface to be cleaned using suction force generated by the fan motor 570. The bottom surface of the suction unit 520 is provided with a brush (not shown) to facilitate cleaning of carpets, or the like.

The cyclone dust collector 530 receives air sucked by the suction unit 520, separates dust from the air, and collects the separated dust. The cyclone dust collector 530 is separably installed from the motor housing 515, such that the user may separate the cyclone dust collector 530 from the main body 510 and clean the cyclone dust collector 530.

The handle 550 and the main body 510 are connected to each other via a connection frame 525. In addition, a control pad 555 through which an instruction to control the vacuum cleaner 5 is input is mounted at one portion of the handle 550 and receives the instruction related to controlling of the vacuum cleaner 5. In this regard, when the user inputs a control instruction via the control pad 555, an input event may be generated.

The vacuum cleaner sensor unit 560 detects a state of the vacuum cleaner 5 or senses change in the state of the vacuum cleaner 5 and transmits the detected result to the vacuum cleaner controller 590. The vacuum cleaner sensor unit 560 may include various sensors to detect the state of the vacuum cleaner 5. For example, the vacuum cleaner sensor unit 560 may include a sensor to sense an amount of dust contained in the cyclone dust collector 530, a sensor to sense jamming of foreign matters in the suction unit 520, a sensor to sense a remaining capacity of a battery (not shown) when the vacuum cleaner 5 operates by using a built-in battery, and the like.

The fan motor 570 has a first function. In more detail, the fan motor 570 reduces internal pressure of the motor housing 515 lower than external pressure using rotation force so that the suction unit 520 sucks air and the sucked air is transferred to the cyclone dust collector 530. Meanwhile, as the fan motor 570 performs the first function, vibration occurs in the fan motor 570. In addition, the fan motor 570 may further perform a second function to generate a tactile signal for notification of an event according to controlling of the vacuum cleaner controller 590.

A vacuum cleaner storage unit 580 may store programs and data to control operation of the vacuum cleaner 5. The vacuum cleaner storage unit 580 may also include driving information such as operation time of the vacuum cleaner 5 and filter replacement period. As described above, the fan motor 570, as a tactile signal generator 2, may generate tactile signals having different patterns according to the events. To this end, the vacuum cleaner storage unit 580 may have a pattern database to store patterns of tactile signals to be generated with respect to each event.

When an event is generated, the vacuum cleaner controller 590 may notify the user of generation of the event by driving the fan motor 570. Particularly, when an event is generated, the vacuum cleaner controller 590 may drive the fan motor 570 to generate a tactile signal and provide a tactile feedback to the user. In addition, when an event is generated, the vacuum cleaner controller 590 may search for a pattern of a tactile signal corresponding to the event and may control the fan motor 570 to generate the tactile signal in accordance to the searched pattern of the tactile signal.

For example, when the user inputs a control instruction through the control pad 555, the vacuum cleaner controller 590 may determine that an input feedback is generated and control the fan motor 570 to generate a tactile signal corresponding to the input feedback. In addition, when a driving event related to driving of the vacuum cleaner 5 is generated, for example, when a remaining electric energy of the battery of the vacuum cleaner 5 is reduced less than a critical point, or when an inspection event related to an inspection of the vacuum cleaner 5 is generated, for example, when the amount of dust contained in the cyclone dust collector 530 of the vacuum cleaner 5 is greater than a critical point, the vacuum cleaner controller 590 may control the fan motor 570 to generate a tactile signal corresponding to the generated event.

Figure 13:
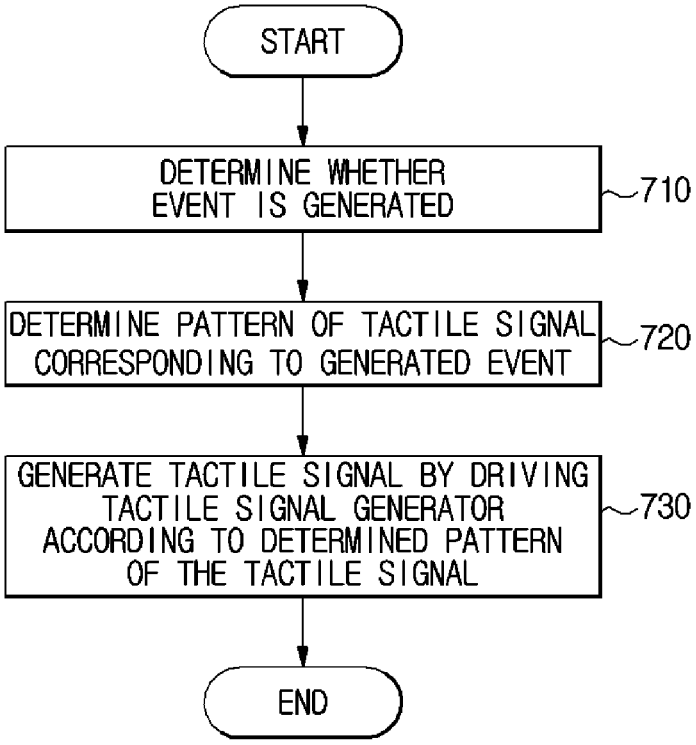
FIG. 13 is a flowchart for describing a method of controlling a home appliance according to an embodiment of the present disclosure.

FIG. 13 is a flowchart for describing a method of controlling a home appliance 1 according to an embodiment of the present disclosure.

Referring to FIG. 13, a controller 3 determines whether an event is generated (710). Here, the event may include an input event generated by a user input, a driving event generated during driving of the home appliance 1, an inspection event generated with regard to an inspection of the home appliance 1, and the like as described above.

The controller 3 may determine a pattern of a tactile signal corresponding to the generated event (720). More particularly, the home appliance 1 may generate tactile signals having different patterns on an event basis. To this end, the home appliance 1 may pre-store patterns of tactile signals to be generated with respect to each event and may determine the pattern of the tactile signal corresponding to the generated event. Alternatively, the pattern of the tactile signal may be determined according to a pattern of an audio signal. The home appliance 1 notifies the user of generation of the event by generating an audio signal on the event basis. The tactile signal may be generated in the same pattern as the audio signal. For example, a higher sound may generate a stronger vibration, and a lower sound may generate a weaker vibration.

A tactile signal is generated by driving a tactile signal generator 2 in accordance with a searched tactile signal code (730). More particularly, when current is supplied to the tactile signal generator 2 in accordance with the determined pattern of the tactile signal, the tactile signal generator 2 may generate a tactile signal according to the determined pattern of the tactile signal.

Since a feedback regarding the event is provided using the tactile signal, users having hearing and visual impairments may also receive the feedback regarding generation of the event.

In addition, a feedback regarding generation of the event may be provided to the user more efficiently by generating different tactile signals on the event basis.

As is apparent from the above description, a home appliance 1 may efficiently notify the user of generation of events by generating tactile signals corresponding to various events.

Furthermore, users having hearing and visual impairments may also be notified of generation of the event by generating a tactile signal and providing the tactile signal to the users.

In addition, tactile signals may be generated without using an additional device since an existing tactile signal generator 2 of the home appliance 1 is used to generate the tactile signals.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A home appliance comprising:

a tactile signal generator configured to perform a first function comprising a predetermined operation of the home appliance and a second function to generate a tactile signal providing notice of an event; and a controller configured to determine whether the event is generated and to control the generation of the tactile signal generated by the tactile signal generator to provide a user with tactile feedback, wherein the event comprises at least one event selected from the group consisting of an input event generated by a setting input for the home appliance, a driving event generated during driving of the home appliance, and an inspection event generated related to an inspection of the home appliance, and the controller determines whether the setting input the home appliance is a normal input, and determines that an input event is generated upon determination that the input is an abnormal input.

2. The home appliance according to claim 1, wherein the tactile signal comprises vibration.

3. The home appliance according to claim 1, further comprising at least one sensor to detect a state of the home appliance, wherein the controller determines whether the driving event is generated based on a driving state of the home appliance detected by the at least one sensor.

4. The home appliance according to claim 1, further comprising a storage unit to store history information related to driving of the home appliance, wherein the controller determines whether the inspection event is generated based on the history information.

5. The home appliance according to claim 1, wherein the controller determines a pattern of the tactile signal in accordance with the event.

6. The home appliance according to claim 1, further comprising a sound generator to generate an audio signal when the event is generated.

7. The home appliance according to claim 6, wherein a pattern of the audio signal is determined in accordance with a pattern of the tactile signal.

8. The home appliance according to claim 6, wherein the controller controls the tactile signal generator or the sound generator to generate at least one signal selected from the group consisting of the audio signal and the tactile signal.

9. The home appliance according to claim 1, wherein the tactile signal generator comprises a drain pump to discharge water from a washing tub.

10. The home appliance according to claim 3, wherein the sensor comprises at least one sensor selected from the group consisting of: a weight sensor to sense a weight of a tub containing water; and a door sensor to sense whether a door is opened or closed, and the controller determines whether laundry is remained in the tub using the at least one sensor selected from the group consisting of the weight sensor and the door sensor, and determines that the driving event is generated upon determination that the laundry is remained in the tub.

11. The home appliance according to claim 4, wherein the tactile signal generator comprises a drain pump comprising a pump filter to remove foreign matters contained in wash water introduced from a tub, and the controller determines whether replacement of the pump filter is required based on the history information, and determines that the inspection event is generated upon determining that replacement of the pump filter is required.

12. The home appliance according to claim 4, further comprising a washing tub rotatably installed in a tub and configured to accommodate laundry, wherein the controller determines whether cleaning of the washing tub is required based on the history information, and determines that the inspection event is generated upon determining that cleaning of the pump filter is required.

13. The home appliance according to claim 4, further comprising a water supply valve comprising a water supply filter to remove foreign matters contained in water supplied to the tub, and wherein the controller determines whether replacement of the water supply filter is required by comparing normal water supplying time with real water supplying time, and determines that the inspection event is generated upon determining that replacement of the water supply filter is required.

14. The home appliance according to claim 1, wherein the tactile signal generator comprises a fan motor of a vacuum cleaner.

15. The home appliance according to claim 14, wherein the fan motor generates the tactile signal according to a tactile signal pattern corresponding to the event when determined that the event is generated.

16. The home appliance according to claim 1, wherein the tactile signal is at least one of a vibration, a micro electrical stimulation and an ultrasound.

17. A method of controlling a home appliance comprising a tactile signal generator configured to perform a first function comprising a predetermined operation of the home appliance and a second function to generate a tactile signal providing notice of an event; the method comprising:

determining whether the event is generated; and generating a tactile signal by driving the tactile signal generator to provide a user with tactile feedback according to the generated event, wherein the event comprises at least one event selected from the group consisting of an input event generated by a setting input, a driving event generated during driving of the home appliance, and an inspection event generated related to an inspection of the home appliance, and the determining of whether the event is generated comprises determining that a setting input the home appliance is a normal input and determines that an input event is generated upon determination that the input is an abnormal input.

18. The method according to claim 17, wherein the determining of whether an event is generated comprises determining that the input event is generated when the user input is generated.

19. The method according to claim 17, wherein the determining of whether an event is generated comprises:

detecting a state of the home appliance; and determining whether the driving event is generated based on the detected state of the home appliance.

20. The method according to claim 18, wherein the determining of whether an event is generated comprises determining whether the inspection event is generated based on history information related to driving of the home appliance.

21. The method according to claim 17, further comprising searching for a pattern of the tactile signal corresponding to the generated event, wherein the generating of the tactile signal comprises generating the tactile signal in accordance with the searched pattern of the tactile signal.

22. The method according to claim 17, wherein the generating of the tactile signal comprises generating an audio signal in accordance with the generated event.

23. The home appliance according to claim 22, wherein a pattern of the audio signal is determined in accordance with a pattern of the tactile signal.

* * * * *